US012808021B2

(12) United States Patent
Arita et al.

(10) Patent No.: US 12,808,021 B2
(45) Date of Patent: Nov. 24, 2026

(54) HOT ROLLED STEEL SHEET FOR NON ORIENTED ELECTRICAL STEEL SHEET, PRODUCING METHOD OF HOT ROLLED STEEL SHEET FOR NON ORIENTED ELECTRICAL STEEL SHEET, AND PRODUCING METHOD OF NON ORIENTED ELECTRICAL STEEL SHEET

(71) Applicant: NIPPON STEEL CORPORATION, Tokyo (JP)

(72) Inventors: Yoshihiro Arita, Tokyo (JP); Masahiro Fujikura, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 370 days.

(21) Appl. No.: 18/275,704

(22) PCT Filed: Feb. 19, 2021

(86) PCT No.: PCT/JP2021/006344

§ 371 (c)(1),
(2) Date: Aug. 3, 2023

(87) PCT Pub. No.: WO2022/176158

PCT Pub. Date: Aug. 25, 2022

(65) Prior Publication Data

US 2024/0295014 A1 Sep. 5, 2024

(51) Int. Cl.

| | |
|---|---|
| ***C22C 38/02*** | (2006.01) |
| ***C21D 6/00*** | (2006.01) |
| ***C21D 8/1216*** | (2026.01) |
| ***C21D 8/1244*** | (2026.01) |
| ***C21D 9/46*** | (2006.01) |
| ***C22C 38/00*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.

CPC ..... *C22C 38/02* (2013.01); *C21D 6/008* (2013.01); *C21D 8/1222* (2013.01); *C21D 8/1233* (2013.01); *C21D 8/1272* (2013.01); *C21D 9/46* (2013.01); *C22C 38/004* (2013.01); *C22C 38/04* (2013.01); *C22C 38/06* (2013.01); *C22C 38/12* (2013.01); *C22C 38/14* (2013.01); *C21D 2211/004* (2013.01); *C21D 2211/005* (2013.01)

(58) Field of Classification Search
None
See application file for complete search history.

(56) References Cited

U.S. PATENT DOCUMENTS

2014/0238558 A1 8/2014 Fujikura et al.

FOREIGN PATENT DOCUMENTS

| | | | | | |
|---|---|---|---|---|---|
| CN | 100999050 | A | | 7/2007 | |
| JP | 05-287383 | A | | 11/1993 | |
| JP | 6-192731 | A | | 7/1994 | |
| JP | 2000219916 | A | * | 8/2000 | |
| JP | 2006-241554 | A | | 9/2006 | |
| JP | 2007-217744 | A | | 8/2007 | |
| KR | 20050064415 | A | * | 6/2005 | ..... C22C 38/004 |
| WO | WO 2013/069754 | A1 | | 5/2013 | |

OTHER PUBLICATIONS

Effect of non-metallic precipitates and grain size on core loss of non-oriented electrical silicon steels (Year: 2018).*
50W800 Non-Oriented Silicon Steel Coil.*

* cited by examiner

*Primary Examiner* — Jenny R Wu
(74) *Attorney, Agent, or Firm* — Birch, Stewart, Kolasch & Birch, LLP

(57) ABSTRACT

A hot rolled steel sheet for a non oriented electrical steel sheet according to the present invention includes a predetermined amount of Si, Mn, Al, Ti, Nb, V, and Zr as a chemical composition, wherein when viewing a cross section which is parallel to a rolling direction and a thickness direction, an AlN with an equivalent circle diameter of 10 to 200 nm exists in a grain and at a grain boundary of a ferrite grain, a number density of AlN which exists in the grain and at the grain boundary is 8.0 pieces/$\mu m^2$ or less on the basis of an observed area, and a number density of AlN which exists at the grain boundary is 40 pieces/$\mu m^2$ or less on the basis of a grain boundary area.

9 Claims, No Drawings

HOT ROLLED STEEL SHEET FOR NON ORIENTED ELECTRICAL STEEL SHEET, PRODUCING METHOD OF HOT ROLLED STEEL SHEET FOR NON ORIENTED ELECTRICAL STEEL SHEET, AND PRODUCING METHOD OF NON ORIENTED ELECTRICAL STEEL SHEET

TECHNICAL FIELD

The present invention relates to a hot rolled steel sheet for a non oriented electrical steel sheet which can improve magnetic characteristics, a producing method of the hot rolled steel sheet for the non oriented electrical steel sheet, and a producing method of the non oriented electrical steel sheet.

BACKGROUND ART

A non oriented electrical steel sheet is mainly used as core materials for rotating machines or the like. In recent years, even in fields where low grade non oriented electrical steel sheets have been used, the demand for improving the efficiency of machines has increased. Thus, even in the low grade non oriented electrical steel sheet, it is required to increase its magnetic flux density and reduce its iron loss without increasing cost.

Furthermore, in recent years, since the rotating machines have been increasingly controlled by inverters, it is required to improve the iron loss in high frequency. Thus, even in the low grade non oriented electrical steel sheet, it is required to reduce the iron loss in high frequency.

In general, the low grade non oriented electrical steel sheet has a chemical composition in which Si content is lower and α-γ transformation (ferrite-austenite transformation) occurs during producing processes. In the past, for the low grade non oriented electrical steel sheet, a method of improving the magnetic characteristics by omitting hot-rolled sheet annealing has been proposed.

For instance, Patent Document 1 discloses a method in which hot rolling is finished at Ar3 transformation point or more, and slow cooling at 5° C./sec or less is conducted in a temperature range of Ar3 transformation point to Ar1 transformation point. However, it is difficult to achieve the cooling rate in industrial producing process.

Patent Document 2 discloses a method of adding Sn to steel and controlling a final temperature of hot rolling depending on the Sn content in order to obtain high magnetic flux density. However, in the method, the Si content is limited to 0.4% or less, which is insufficient for obtaining low iron loss.

Patent Document 3 proposes a steel sheet having high magnetic flux density where grain growth is improved during stress relief annealing by limiting a heating temperature and a final temperature during hot rolling. However, in the method, the process such as self-annealing substituted for hot-rolled sheet annealing is not conducted, and thus, it is difficult to obtain high magnetic flux density.

Patent Document 4 proposes a method of increasing the magnetic flux density by controlling the chemical composition of steel and hot rolling conditions. In the Patent Document 4, against problems such that AlN is finely precipitated at α grain boundary during transformation from γ to α and the grain growth is suppressed during self-annealing of the hot rolled sheet, a final rolling temperature is controlled to be 800° C. to (Ar1+20° C.) and a coiling temperature is controlled to be 780° C. or more. However, the method cannot fundamentally solve the problem such that AlN precipitates during the transformation from γ to α.

RELATED ART DOCUMENTS

Patent Documents

[Patent Document 1] Japanese Unexamined Patent Application, First Publication No. H06-192731

[Patent Document 2] Japanese Unexamined Patent Application, First Publication No. 2006-241554

[Patent Document 3] Japanese Unexamined Patent Application, First Publication No. 2007-217744

[Patent Document 4] PCT International Publication No. WO2013/069754

SUMMARY OF INVENTION

Technical Problem to be Solved

As described above, in general, the low grade non oriented electrical steel sheet has the chemical composition in which the α-γ transformation occurs during producing processes. In conventional techniques for the low grade non oriented electrical steel sheet, it is tried to improve the magnetic characteristics by conducting the self-annealing substituted for hot-rolled sheet annealing after hot rolling. However, the conventional techniques do not fully satisfy the magnetic characteristics as described above. In particular, the iron loss in high frequency is not sufficiently improved.

The present invention has been made in consideration of the above mentioned situations. An object of the invention is to provide a hot rolled steel sheet for a non oriented electrical steel sheet which can improve the iron loss in high frequency in addition to general magnetic characteristics, a producing method of the hot rolled steel sheet for the non oriented electrical steel sheet, and a producing method of the non oriented electrical steel sheet.

Solution to Problem

An aspect of the present invention employs the following.

(1) A hot rolled steel sheet for a non oriented electrical steel sheet according to an aspect of the present invention, the hot rolled steel sheet includes, as a chemical composition, by mass %, 0.005% or less of C,
0.10 to 1.50% of Si,
0.10 to 0.60% of Mn,
0.100% or less of P,
0.20 to 1.00% of Al,
0.0010 to 0.0030% of Ti,
0.0010 to 0.0030% of Nb,
0.0010 to 0.0030% of V,
0.0010 to 0.0030% of Zr,
0.0030% or less of N,
0 to 0.20% of Sn,
0 to 0.20% of Sb, and
a balance consisting of Fe and impurities, wherein when viewing a cross section which is parallel to a rolling direction and a thickness direction, an AlN with an equivalent circle diameter of 10 to 200 nm exists in a grain and at a grain boundary of a ferrite grain, a number density of the AlN which exists in the grain and at the grain boundary is 8.0 pieces/$\mu m^2$ or less on basis of an observed area, and a number density of the AlN which exists at the grain boundary is 40 pieces/$\mu m^2$ or less on basis of a grain boundary area.

(2) In the hot rolled steel sheet for the non oriented electrical steel sheet according to the above (1), the hot rolled steel sheet may include, as the chemical composition, by mass %, at least one selected from a group consisting of 0.02 to 0.20% of Sn, and 0.02 to 0.20% of Sb.

(3) A producing method of the hot rolled steel sheet for the non oriented electrical steel sheet according to the above (1) or (2), the method includes heating a slab to a temperature range of 1050 to 1180° C., the slab including, as a chemical composition, by mass %, 0.005% or less of C, 0.10 to 1.50% of Si, 0.10 to 0.60% of Mn, 0.100% or less of P, 0.20 to 1.00% of Al, 0.0010 to 0.0030% of Ti, 0.0010 to 0.0030% of Nb, 0.0010 to 0.0030% of V, 0.0010 to 0.0030% of Zr, 0.0030% or less of N, 0 to 0.20% of Sn, 0 to 0.20% of Sb, and a balance consisting of Fe and impurities, rough-rolling the slab after the heating, holding a rough-rolled sheet after the rough-rolling in a temperature range of 850° C. to Ar1 point, reheating the rough-rolled sheet after the holding to a temperature range of more than Ar1 point to Ac1 point, final-rolling the rough-rolled sheet just after the reheating under conditions such that a final temperature of the final-rolling is 800° C. to Ar1 point, and coiling a final-rolled sheet after the final-rolling in a temperature range of 750 to 850° C.

(4) A producing method of a non oriented electrical steel sheet using the hot rolled steel sheet for the non oriented electrical steel sheet according to the above (1) or (2), the method includes cold-rolling the hot rolled steel sheet for the non oriented electrical steel sheet without conducting a hot-rolled sheet annealing, and final-annealing a cold-rolled sheet after the cold-rolling in a range of 800° C. to Ac1 point.

Effects of Invention

According to the above aspects of the present invention, it is possible to provide the hot rolled steel sheet for the non oriented electrical steel sheet which can improve the iron loss in high frequency in addition to general magnetic characteristics, the producing method of the hot rolled steel sheet for the non oriented electrical steel sheet, and the producing method of the non oriented electrical steel sheet.

DETAILED DESCRIPTION OF PREFERRED EMBODIMENTS

Hereinafter, a preferable embodiment of the present invention is described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" does not include in the limitation range. Unless otherwise noted, "%" of the amount of respective elements expresses "mass %".

In the hot rolled steel sheet for the non oriented electrical steel sheet according to the embodiment, morphology of AlN included in the hot rolled steel sheet is controlled by comprehensively and inseparably controlling the chemical composition and the production conditions.

For instance, in the non oriented electrical steel sheet which has the chemical composition in which the α-γ transformation occurs during producing processes and which is produced by conducting the self-annealing substituted for hot-rolled sheet annealing after hot rolling, it is preferable to sufficiently grow grains during self-annealing after hot rolling and during final annealing, in order to improve the magnetic characteristics.

However, AlN included in the hot rolled steel sheet has an effect of pinning the grain boundary migration and suppresses the grain growth. Thus, it is preferable that the amount of AlN included in the hot rolled steel sheet is small.

For instance, Patent Document 4 described above attempts to reduce AlN included in the steel sheet. Indeed, the technique disclosed in Patent Document 4 may be able to reduce AlN included in the steel sheet to a certain extent. However, the technique disclosed in Patent Document 4 cannot fundamentally suppress AlN which precipitates during the transformation from γ to α, and a certain amount of AlN precipitates particularly at the grain boundary of ferrite (α) grain. Thus, the grain could not sufficiently grow during self-annealing after hot rolling and during final annealing.

In the embodiment, by comprehensively and inseparably controlling the chemical composition and the production conditions, number of AlN which exists in the grain and at the grain boundary of α phase is made to be small, and especially, number of AlN which exists at the grain boundary of α phase is made to be small. As a result, since the grain can sufficiently grow during self-annealing after hot rolling and during final annealing, it is possible to obtain the non oriented electrical steel sheet which can improve the iron loss in high frequency in addition to general magnetic characteristics.

Incidentally, Patent Document 4 discloses number density of AlN in steel sheet after final annealing. However, since it seems that AlN which precipitates in hot rolling process is ostwald-ripened during final annealing and the number density of AlN decreases, it cannot necessarily be compared with the AlN number density in the hot rolled steel sheet according to the embodiment. Moreover, since structure of the steel sheet after hot rolling is deformed during subsequent cold rolling and recrystallization and grain growth occur during final annealing, the grain boundary of ferrite after hot rolling does not necessarily correspond to the grain boundary of ferrite after final annealing.

The hot rolled steel sheet for the non oriented electrical steel sheet according to the present embodiment includes, as the chemical composition, by mass %, 0.005% or less of C, 0.10 to 1.50% of Si, 0.10 to 0.60% of Mn, 0.100% or less of P, 0.20 to 1.00% of Al, 0.0010 to 0.0030% of Ti,
0.0010 to 0.0030% of Nb,
0.0010 to 0.0030% of V,
0.0010 to 0.0030% of Zr,
0.0030% or less of N,
0 to 0.20% of Sn,
0 to 0.20% of Sb, and
a balance consisting of Fe and impurities, wherein
when viewing a cross section which is parallel to a rolling direction and a thickness direction,
AlN with an equivalent circle diameter of 10 to 200 nm exists in the grain and at the grain boundary of the ferrite grain,
the number density of AlN which exists in the grain and at the grain boundary is 8.0 pieces/$\mu m^2$ or less on the basis of observed area, and
the number density of the AlN which exists at the grain boundary is 40 pieces/$\mu m^2$ or less on the basis of grain boundary area.

<Chemical Composition of Hot Rolled Steel Sheet>

Herein, the limitation reasons in regard to the chemical composition of the hot rolled steel sheet for the non oriented electrical steel sheet according to the embodiment are described.

In the embodiment, the hot rolled steel sheet includes, as the chemical composition, base elements, optional elements as necessary, and the balance consisting of Fe and impurities.

0.005% or Less of C

C is an element which deteriorates the iron loss and causes the magnetic aging. The C content is to be 0.005% or less. The C content is preferably 0.003% or less. It is preferable that the C content is lower, and the lower limit thereof may be 0%. Considering industrial productivity, the C content may be more than 0%, 0.0015% or more, 0.0020% or more, or 0.0025% or more.

0.10 to 1.50% of Si

Si is an element which increases electrical resistance of steel and reduces the iron loss. Thus, the lower limit of the Si content is to be 0.10%. On the other hand, when the content is excessive, magnetic flux density decreases. Thus, the upper limit of the Si content is to be 1.50%. The lower limit of the Si content is preferably 0.50%, and the upper limit of the Si content is preferably 1.20%.

0.10 to 0.60% of Mn

Mn is an element which increases the electrical resistance of steel and makes sulfides coarsen to render the sulfides harmless. Thus, the lower limit of the Mn content is to be 0.10%. On the other hand, when the content is excessive, the steel becomes brittle, and the cost increases. Thus, the upper limit of the Mn content is to be 0.60%.

0.100% or Less of P

P makes hardness of the steel sheet increase but makes steel brittle. The P content is to be 0.100% or less. The P content is preferably 0.08% or less. It is preferable that the P content is lower, and the lower limit thereof may be 0%. Considering industrial productivity, the P content may be 0.001% or more.

0.20 to 1.00% of Al

Al is an element which deoxidizes the steel, increases the electrical resistance, makes $\alpha$-$\gamma$ transformation point higher, and forms AlN. Thus, the lower limit of Al content is to be 0.20%. On the other hand, when the content is excessive, the magnetic flux density decreases and workability decreases. Thus, the upper limit of the Al content is to be 1.00%. The upper limit of the Al content is preferably 0.80%.

0.0010 to 0.0030% of Ti

Ti is an element which forms nitrides and sufficiently precipitates as the nitrides even in $\gamma$ phase in contrast to AlN. In the embodiment, in order to suppress fine precipitation of AlN at $\alpha$ grain boundary during transformation from $\gamma$ to $\alpha$, Ti is important as the element to form the nitrides. Thus, the lower limit of the Ti content is to be 0.0010%. On the other hand, when the content is excessive, carbides are formed, and thus, the grain growth during final annealing deteriorates. Thus, the upper limit of the Ti content is to be 0.0030%.

0.0010 to 0.0030% of Nb

Nb is an element which forms nitrides and sufficiently precipitates as the nitrides even in $\gamma$ phase in contrast to AlN. In the embodiment, in order to suppress fine precipitation of AlN at $\alpha$ grain boundary during transformation from $\gamma$ to $\alpha$, Nb is important as the element to form the nitrides. Thus, the lower limit of the Nb content is to be 0.0010%. On the other hand, when the content is excessive, carbides are formed, and thus, the grain growth during final annealing deteriorates. Thus, the upper limit of the Nb content is to be 0.0030%.

0.0010 to 0.0030% of V

V is an element which forms nitrides and sufficiently precipitates as the nitrides even in $\gamma$ phase in contrast to AlN. In the embodiment, in order to suppress fine precipitation of AlN at $\alpha$ grain boundary during transformation from $\gamma$ to $\alpha$, V is important as the element to form the nitrides. Thus, the lower limit of the V content is to be 0.0010%. On the other hand, when the content is excessive, carbides are formed, and thus, the grain growth during final annealing deteriorates. Thus, the upper limit of the V content is to be 0.0030%.

0.0010 to 0.0030% of Zr

Zr is an element which forms nitrides and sufficiently precipitates as the nitrides even in $\gamma$ phase in contrast to AlN. In order to suppress fine precipitation of AlN at a grain boundary during transformation from $\gamma$ to $\alpha$, Zr is important as the element to form the nitrides. Thus, the lower limit of the Zr content is to be 0.0010%. On the other hand, when the content is excessive, carbides are formed, and thus, the grain growth during final annealing deteriorates. Thus, the upper limit of the Zr content is to be 0.0030%.

0.0030% or Less of N

N is an element which forms AlN and is not favorable for the grain growth. In the embodiment, the N content is to be 0.0030% or less as the allowable upper limit for rendering N harmless. It is preferable that the N content is lower, and the lower limit thereof may be 0%. Considering industrial productivity, the N content may be 0.0001% or more. For instance, when the N content is 0.0001% or more, AlN tends to be formed and the grain growth tends to be suppressed.

0 to 0.20% of Sn 0 to 0.20% of Sb

Sn and Sb improve texture after cold rolling and recrystallization, and thus, improve the magnetic flux density. Thus, Sn and Sb may be included as necessary. For instance, the lower limits of the Sn content and the Sb content are preferably 0.02%, and more preferably 0.03%. On the other hand, when the content is excessive, the steel becomes brittle. Thus, the upper limits of the Sn content and the Sb content are to be 0.20%. The upper limits of the Sn content and the Sb content are preferably 0.10%.

In so far as at least one of Sn and Sb is included, the above effects can be obtained. Thus, it is preferable that at least one selected from the group consisting of 0.02 to 0.20 mass % of Sn and 0.02 to 0.20 mass % of Sb is included as the chemical composition.

The above chemical composition of the hot rolled steel sheet according to the embodiment corresponds to the chemical composition in which the α-γ transformation occurs during producing processes.

In the embodiment, impurities may be included as the chemical composition. The impurities are elements which do not impair the effects of the embodiment even when it is contained and correspond to elements which are contaminated during industrial production of steel sheet from ores and scrap that are used as a raw material of steel, or from environment of a production process. For instance, the upper limit of the total content of impurities may be 5%.

The chemical composition as described above may be measured by typical analytical methods for the steel. For instance, the chemical composition may be measured by using ICP-AES (Inductively Coupled Plasma-Atomic Emission Spectrometer: inductively coupled plasma emission spectroscopy spectrometry). Specifically, it is possible to obtain the chemical composition by conducting the measurement by Shimadzu ICPS-8100 or the like (measurement device) under the condition based on calibration curve prepared in advance using samples with 35 mm square taken from the steel sheet. In addition, C may be measured by the infrared absorption method after combustion, and N may be measured by the thermal conductometric method after fusion in a current of inert gas.

A slab is made by casting molten steel whose composition is controlled so that the hot rolled steel sheet has the chemical composition described above. The casting method of slab is not particularly limited. Moreover, even when a steel piece is made in a vacuum furnace or the like for research and development, as to the chemical composition, it is confirmed that the effects thereof are the same as those in the case where the slab is made.

<AlN Included in Hot Rolled Steel Sheet>

The limitation reasons in regard to AlN included in the hot rolled steel sheet for the non oriented electrical steel sheet according to the embodiment are described.

As described above, in the embodiment, the morphology of AlN included in the hot rolled steel sheet is controlled by comprehensively and inseparably controlling the chemical composition and the production conditions. In particular, in the embodiment, the precipitation of AlN at the grain boundary of α grain is suppressed.

In the hot rolled steel sheet for the non oriented electrical steel sheet according to the embodiment,

- when viewing the cross section which is parallel to the rolling direction and the thickness direction,
- AlN with the equivalent circle diameter of 10 to 200 nm exists in the grain and at the grain boundary of the ferrite grain (α grain),
- the number density (number density in total) of AlN which exists in the grain and at the grain boundary is 8.0 pieces/$\mu m^2$ or less on the basis of observed area, and
- the number density (number density at the grain boundary) of the AlN which exists at the grain boundary is 40 pieces/$\mu m^2$ or less on the basis of grain boundary area.

In the embodiment, as the size of AlN which mostly affects the grain growth, AlN with the equivalent circle diameter of 10 to 200 nm is controlled. In the hot rolled steel sheet for the non oriented electrical steel sheet according to the embodiment, AlN with the above size is included in the grain and at the grain boundary of α grain.

When the number density of AlN with the above size which exists in the grain and at the grain boundary of α grain is more than 8.0 pieces/$\mu m^2$ on the basis of observed area, the grain growth is insufficient during self-annealing and during final annealing. As a result, the magnetic flux density and the core loss deteriorate for the non oriented electrical steel sheet. Thus, the number density of AlN with the above size which exists in the grain and at the grain boundary of α grain is to be 8.0 pieces/$\mu m^2$ or less on the basis of observed area. On the other hand, it is preferable that the number density of AlN with the above size which exists in the grain and at the grain boundary of α grain is lower, and the lower limit thereof may be 0 pieces/$\mu m^2$ on the basis of observed area. However, since it is difficult to actually control the above number density to be 0 pieces/$\mu m^2$, from an industrial standpoint, the number density of AlN with the above size which exists in the grain and at the grain boundary of α grain may be 0.1 pieces/$\mu m^2$ or more on the basis of observed area.

In addition, since it is insufficient to only control the number density (number density in total) of AlN with the above size which exists in the grain and at the grain boundary of α grain in order to improve the iron loss in high frequency, it is preferable to control the number density (number density at the grain boundary) of AlN with the above size which exists at the grain boundary of α grain.

When the number density of AlN with the above size which exists at the grain boundary of α grain is more than 40 pieces/$\mu m^2$ on the basis of grain boundary area, the grain growth is insufficient during self-annealing and during final annealing. As a result, the core loss in high frequency deteriorates for the non oriented electrical steel sheet. Thus, the number density of AlN with the above size which exists at the grain boundary of α grain is to be 40 pieces/$\mu m^2$ or less on the basis of grain boundary area. The number density is preferably 35 pieces/$\mu m^2$ or less. On the other hand, it is preferable that the number density of AlN with the above size which exists at the grain boundary of α grain is lower, and the lower limit thereof may be 0 pieces/$\mu m^2$ on the basis of grain boundary area. However, since it is difficult to actually control the above number density to be 0 pieces/$\mu m^2$, from an industrial standpoint, the number density of AlN with the above size which exists at the grain boundary of α grain may be 0.5 pieces/$\mu m^2$ or more on the basis of grain boundary area.

AlN included in the hot rolled steel sheet may be identified using TEM-EDS (Transmission Electron Microscope-Energy Dispersive X-ray Spectroscopy). For instance, a thin film sample is taken from the hot rolled steel sheet so that an observed section is the cross section which is parallel to the rolling direction and the thickness direction, the precipitate in which the atomic ratio of Al and N is approximately 1:1 may be identified in the observed visual field, based on the results of the observation and the quantitative analysis of TEM-EDS. A diameter of circle which an identified area of AlN is converted into is defined as the equivalent circle diameter. The number density (number density in total) of AlN which exists in the grain and at the grain boundary of a grain and the number density (number density at the grain boundary) of AlN which exists at the grain boundary of α grain may be obtained by identifying AlN with the equivalent circle diameter of 10 to 200 nm which exist in the observed visual field (observed area). For instance, the observed visual field may be at least in a range of 10 μm×10 μm. The number of AlN which exists at the grain boundary is regarded as the number of AlN which exists within distance from the grain boundary inside 0.2 μm into each grain contacted with the grain boundary. The grain boundary area may be regarded as a value obtained by multiplying a total length of the grain boundary by 0.4 μm in the visual field observed by TEM-EDS. In order to obtain the equivalent circle diameter, an image obtained by TEM-EDS observation may be read by a scanner or the like and analyzed using commercially available image analysis software.

<Producing Method of Hot Rolled Steel Sheet>

Herein, the producing method of the hot rolled steel sheet for the non oriented electrical steel sheet according to the embodiment is described.

The producing method of the hot rolled steel sheet for the non oriented electrical steel sheet according to the embodiment is for producing the hot rolled steel sheet explained above, and the method includes heating a slab to a temperature range of 1050 to 1180° C., the slab including, as a chemical composition, by mass %, 0.005% or less of C, 0.10 to 1.50% of Si, 0.10 to 0.60% of Mn, 0.100% or less of P, 0.20 to 1.00% of Al, 0.0010 to 0.0030% of Ti, 0.0010 to 0.0030% of Nb, 0.0010 to 0.0030% of V, 0.0010 to 0.0030% of Zr, 0.0030% or less of N, 0 to 0.20% of Sn, 0 to 0.20% of Sb, and a balance consisting of Fe and impurities, rough-rolling the slab after the heating, holding a rough-rolled sheet after the rough-rolling in a temperature range of 850° C. to Ar1 point, reheating the rough-rolled sheet after the holding to a temperature range of more than Ar1 point to Ac1 point, final-rolling the rough-rolled sheet just after the reheating under conditions such that a final temperature of the final-rolling is 800° C. to Ar1 point, and coiling a final-rolled sheet after the final-rolling in a temperature range of 750 to 850° C.

In the embodiment, an attempt is made to improve the magnetic characteristics of the non oriented electrical steel sheet by self-annealing the coil after final rolling of hot rolling. For instance, in the embodiment, the slab is heated to the range of 1050 to 1180° C. and rough-rolled in hot rolling, the rough-rolled sheet is held in the range of 850° C. to Ar1 point, the rough-rolled sheet after the holding is heated to the range of more than Ar1 point to Ac1 point and final-rolled, and the final-rolled sheet is coiled in the range of 750 to 850° C. By the above production conditions, it is possible to favorably suppress the precipitation of AlN to the grain boundary of α phase. As a result, the grain is favorably grown during self-annealing and during final annealing, and thus, it is possible to obtain excellent iron loss and excellent magnetic flux density as the non oriented electrical steel sheet.

The chemical composition of slab is the same as the chemical composition of the hot rolled steel sheet described above. In the production of the non oriented electrical steel sheet, the chemical compositions hardly change in the processes from the slab to the obtained hot rolled steel sheet. The chemical composition of the above slab corresponds to the chemical composition in which the α-γ transformation occurs during producing processes.

The heating temperature of slab is to be 1180° C. or less, in order to prevent the precipitates from being solid-soluted again and then from finely precipitating for suppressing the deterioration of the iron loss. However, when the heating temperature of slab is excessively low, deformation resistance may be excessively large, and thus, it may become to conduct the hot rolling. Thus, the heating temperature of slab is to be 1050° C. or more. The lower limit of the heating temperature of slab is preferably 1080° C. The upper limit of the heating temperature of slab is preferably 1150° C., and more preferably 1130° C.

Conditions for rough rolling are not particularly limited, and known conditions for rough rolling may be applied.

The rough rolled sheet after rough rolling is held at Ar1 point or less to transform into α phase. The Ar1 point is a temperature at which the transformation into α phase finishes during cooling. The rough rolled sheet just after rough rolling has a dual phase structure of α phase and γ phase. In the embodiment, since Ti, Nb, V, and Zr are essentially included as the chemical composition, the nitrides of Ti, Nb, V, and Zr are formed in γ phase, the number of AlN included in the steel decreases, and the amount of the solid-soluted N in the steel decreases. However, a certain amount of N is still solid-soluted in the steel. Thus, the rough rolled sheet after rough rolling is made to be held at Ar1 point or less, and the steel structure is transformed into a single phase structure of α phase whose solubility of N is low. As a result, N which is solid-soluted in the steel sufficiently precipitates as the nitrides (for instance, AlN). By conducting the above heat cycle and reducing the amount of the solid-soluted N, it is possible to suppress the precipitation of the large amount of nitrides after final rolling.

As a result of investigations by the present inventors, it is found that AlN precipitated after rough rolling and before final rolling does not tend to become AlN which exists at the grain boundary of α phase. Although the reason is not clear in detail at this time, it is thought that the existent position (in the grain or at the grain boundary) is changed by static and dynamic microstructural change derived from final rolling even when AlN precipitates at the grain boundary after rough rolling and before final rolling. Thus, it is considered that the number of AlN which exists at the grain boundary of a phase eventually decreases. Specifically, in the embodiment, it is important to make N which is solid-soluted in the steel to be sufficiently precipitated as the nitrides (for instance, AlN) after rough rolling and before final rolling, and also important to make the nitrides not to be solid-soluted again after final rolling. For instance, it is considered that, if the nitrides are solid-soluted again after final rolling, N which is solid-soluted again in the steel is precipitated as AlN preferentially at the grain boundary of α phase during cooling after final rolling.

For the above reason, the rough rolled sheet after rough rolling is held at Ar1 point or less. On the other hand, when the holding temperature is excessively low, the nitrides are difficult to precipitate and grow. Thus, the rough rolled sheet after rough rolling is held at 850° C. or more.

Cooling rate for cooling the rough rolled sheet after rough rolling to the temperature range of 850° C. to Ar1 point is not particularly limited. However, it is preferable that the rough rolled sheet after rough rolling is cooled by an average cooling rate of 0.1 to 2° C./sec to the temperature range of 850° C. to Ar1 point. When the average cooling rate is 0.1° C./sec or less, production efficiency may deteriorates. When the average cooling rate is 2° C./sec or more, the nitrides may be difficult to precipitate and grow.

The rough rolled sheet after being held at the temperature range of 850° C. to Ar1 point is reheated to the temperature range of more than Ar1 point to Ac1 point. As described above, the Ar1 point is the temperature at which the transformation into α phase finishes during cooling. The Ac1 point is a temperature at which the transformation into γ phase starts during heating. In the rough rolled sheet after being held at the temperature range of 850° C. to Ar1 point, the steel structure is transformed into the single phase structure of α phase. However, when the temperature of the rough rolled sheet is the above, the temperatures of final rolling and coiling become excessively low. Thus, in order to increase the effect of self-annealing in a state of being coiled by increasing the temperatures of final rolling and coiling, the rough rolled sheet after being held described above is reheated. When the reheating temperature is more than Ac1 point, the transformation from α phase to γ phase occurs, N is solid-soluted again in the steel, and N which is solid-soluted again is precipitated as the nitrides (for instance, AlN) during cooling after final rolling. In particular, the nitrides precipitate sufficiently at the grain boundary of α phase, and as a result, the grain growth is suppressed during self-annealing and during final annealing. Thus, the reheating temperature is to be Ac1 point or less. On the other hand, in order to sufficiently obtain the effect of self-annealing by increasing the temperatures of final rolling and coiling, the reheating temperature is to be more than Ar1 point. In so far as the temperature is with the range, the heating may be repeated. Moreover, a method for reheating is not particularly limited, and induction heating or the like may be used. The temperatures of Ar1 and Ac1 may be determined experimentally.

The rough rolled sheet after reheating to the temperature range of more than Ar1 point to Ac1 point is final-rolled. The final temperature of final rolling is to be 800° C. to Ar1 point. As described above, the Ar1 point is the temperature at which the transformation into α phase finishes during cooling. When the final temperature of final rolling is less than 800° C., it is difficult to ensure sufficient coiling temperature. Thus, the final temperature of final rolling is to be 800° C. or more. On the other hand, when the final temperature of final rolling is more than Ar1 point, a certain amount of γ phase remains in the steel structure of the final rolled sheet, the transformation from γ to α occurs during coiling after final rolling, N which is solid-soluted in γ phase is precipitated at the grain boundary of α phase, and as a result, the grain growth is suppressed during self-annealing and during final annealing. Thus, the final temperature of final rolling is to be Ar1 point or less.

The coiling temperature of the final rolled sheet is to be 750 to 850° C. When the coiling temperature is less than 750° C., the grain does not sufficiently grow during self-annealing. Thus, the coiling temperature is to be 750° C. or more. On the other hand, when the coiling temperature is more than 850° C., the surface scale (surface oxide) of the final rolled sheet becomes excessive, and descaling by pickling becomes difficult. Thus, the coiling temperature is to be 850° C. or less.

In the hot rolled steel sheet produced by satisfying the production conditions described above, the number of AlN which exists in the grain and at the grain boundary of a phase decreases, and especially, the number of AlN which exists at the grain boundary of a phase decreases. As a result, since the grain can sufficiently grow during self-annealing after hot rolling and during final annealing, it is possible to obtain the non oriented electrical steel sheet which can improve the iron loss in high frequency in addition to general magnetic characteristics.

<Producing Method of Non Oriented Electrical Steel Sheet>

Herein, the producing method of the non oriented electrical steel sheet according to the embodiment is described.

The producing method of the non oriented electrical steel sheet according to the embodiment is for producing the non oriented electrical steel sheet using the hot rolled steel sheet explained above, and the method includes cold-rolling the hot rolled steel sheet produced by satisfying the production conditions described above without conducting the hot-rolled sheet annealing, and final-annealing the cold-rolled sheet after the cold-rolling in the range of 800° C. to Ac1 point.

The hot rolled steel sheet produced by satisfying the production conditions described above is pickled, cold-rolled, and final-annealed. Conditions for cold rolling are not particularly limited, and known conditions for cold rolling may be applied.

The final annealing temperature is to be 800° C. to Ac1 point. When the final annealing temperature is less than 800° C., a non recrystallized structure remains, and the magnetic characteristics deteriorate. Thus, the final annealing temperature is to be 800° C. or more. On the other hand, when the final annealing temperature is more than Ac1 point, the transformation from α to γ occurs, and the magnetic characteristics deteriorate. Thus, the final annealing temperature is to be Ac1 point or less.

The final annealing time is preferably 10 to 600 seconds. In so far as the time is with the range, the grain can sufficiently grow.

The non oriented electrical steel sheet produced by satisfying the production conditions described above is excellent in the iron loss in high frequency in addition to general magnetic characteristics.

It is preferable that the iron loss in the non oriented electrical steel sheet is lower. For instance, the iron loss W15/50 is preferably less than 5.2 W/kg, and the iron loss W10/200 is preferably less than 18.0 W/kg. Moreover, it is preferable that the magnetic flux density in the non oriented electrical steel sheet is higher. For instance, the magnetic flux density B50 is preferably 1.69 T or more, and the magnetic flux density B25 is preferably 1.62 T or more.

The magnetic characteristics of electrical steel sheet such as the magnetic flux density may be measured by a known method. For instance, the magnetic characteristics of electrical steel sheet may be measured on the basis of the epstein test regulated by JIS C2550: 2011, the single sheet tester (SST) method regulated by JIS C 2556: 2015, or the like. In a case where a steel piece is made in a vacuum furnace or the like for research and development, it may be difficult to take a test piece of the same size as that produced industrially. In the case, for instance, a test piece of width 55 mm×length 55 mm may be taken and measured on the basis of the single sheet tester. Moreover, in order to obtain a measurement value equivalent to that measured on the basis of the epstein test, the obtained result may be multiplied by a correction factor. In the embodiment, the magnetic characteristics are measured by the method on the basis of the single sheet tester.

EXAMPLES

The effects of an aspect of the present invention are described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

Example 1

A slab with the chemical composition shown in Tables 1A to 1B was hot-rolled to a thickness of 2.5 mm under production condition corresponding to a reference sign of hot rolling shown in Tables 2A to 2B, and a hot rolled steel sheet was coiled.

TABLE 1A

| STEEL | CHEMICAL COMPOSITION OF SLAB (STEEL PIECE) (IN UNITS OF MASS %, BALANCE CONSISTING OF Fe AND IMPURITIES) | | | | | | | | | | | | Ar1 | Ac1 |
|---|---|---|---|---|---|---|---|---|---|---|---|---|---|---|
| TYPE | C | Si | Mn | P | Al | Ti | Nb | V | Zr | N | Sn | Sb | ° C. | ° C. |
| A1 | 0.005 | 0.20 | 0.20 | 0.091 | 0.30 | 0.0012 | 0.0021 | 0.0012 | 0.0023 | 0.0012 | — | — | 960 | 1010 |
| A2 | 0.001 | 0.10 | 0.30 | 0.082 | 0.90 | 0.0022 | 0.0019 | 0.0015 | 0.0017 | 0.0023 | — | — | 1060 | 1110 |
| A3 | 0.001 | 1.50 | 0.40 | 0.071 | 0.30 | 0.0018 | 0.0017 | 0.0019 | 0.0013 | 0.0030 | — | — | 1070 | 1120 |
| A4 | 0.001 | 0.30 | 0.10 | 0.062 | 0.60 | 0.0016 | 0.0014 | 0.0022 | 0.0011 | 0.0021 | — | — | 1040 | 1090 |
| A5 | 0.002 | 0.40 | 0.60 | 0.049 | 0.70 | 0.0012 | 0.0022 | 0.0024 | 0.0014 | 0.0015 | — | — | 1020 | 1070 |
| A6 | 0.002 | 0.50 | 0.50 | 0.100 | 0.80 | 0.0027 | 0.0027 | 0.0016 | 0.0018 | 0.0016 | — | — | 1060 | 1110 |
| A7 | 0.003 | 0.60 | 0.30 | 0.033 | 0.20 | 0.0030 | 0.0021 | 0.0017 | 0.0025 | 0.0019 | — | 0.19 | 970 | 1020 |
| A8 | 0.003 | 0.20 | 0.50 | 0.022 | 1.00 | 0.0010 | 0.0011 | 0.0028 | 0.0029 | 0.0025 | — | 0.03 | 1070 | 1120 |
| A9 | 0.004 | 0.80 | 0.20 | 0.011 | 0.50 | 0.0014 | 0.0013 | 0.0029 | 0.0021 | 0.0028 | 0.03 | — | 1060 | 1110 |
| A10 | 0.004 | 0.90 | 0.30 | 0.008 | 0.40 | 0.0018 | 0.0013 | 0.0018 | 0.0030 | 0.0011 | 0.09 | — | 1040 | 1090 |
| A11 | 0.005 | 1.20 | 0.40 | 0.005 | 0.30 | 0.0021 | 0.0019 | 0.0010 | 0.0010 | 0.0017 | 0.06 | — | 1040 | 1090 |
| A12 | 0.002 | 1.30 | 0.50 | 0.012 | 0.20 | 0.0022 | 0.0028 | 0.0030 | 0.0014 | 0.0022 | 0.18 | — | 1020 | 1070 |
| a1 | 0.008 | 0.60 | 0.30 | 0.033 | 0.60 | 0.0016 | 0.0014 | 0.0015 | 0.0017 | 0.0019 | — | — | 980 | 1030 |
| a2 | 0.003 | 0.04 | 0.30 | 0.033 | 0.60 | 0.0016 | 0.0014 | 0.0015 | 0.0017 | 0.0019 | — | — | 935 | 985 |
| a3 | 0.003 | 1.80 | 0.30 | 0.033 | 0.60 | 0.0016 | 0.0014 | 0.0015 | 0.0017 | 0.0019 | — | — | 1100 | 1150 |
| a4 | 0.003 | 0.60 | 0.04 | 0.033 | 0.60 | 0.0016 | 0.0014 | 0.0015 | 0.0017 | 0.0019 | — | — | 1070 | 1120 |

TABLE 1B

| STEEL | CHEMICAL COMPOSITION OF SLAB (STEEL PIECE) (IN UNITS OF MASS %, BALANCE CONSISTING OF Fe AND IMPURITIES) | | | | | | | | | | | | Ar1 | Ac1 |
|---|---|---|---|---|---|---|---|---|---|---|---|---|---|---|
| TYPE | C | Si | Mn | P | Al | Ti | Nb | V | Zr | N | Sn | Sb | ° C. | ° C. |
| a5 | 0.003 | 0.60 | 0.90 | 0.033 | 0.60 | 0.0016 | 0.0014 | 0.0015 | 0.0017 | 0.0019 | — | — | 970 | 1020 |
| a6 | 0.003 | 0.60 | 0.30 | 0.110 | 0.60 | 0.0016 | 0.0014 | 0.0015 | 0.0017 | 0.0019 | — | — | 1040 | 1090 |
| a7 | 0.003 | 0.60 | 0.30 | 0.033 | 0.18 | 0.0016 | 0.0014 | 0.0015 | 0.0017 | 0.0019 | — | — | 1050 | 1100 |
| a8 | 0.003 | 0.60 | 0.30 | 0.033 | 1.05 | 0.0016 | 0.0014 | 0.0015 | 0.0017 | 0.0019 | — | — | 1100 | 1130 |
| a9 | 0.003 | 0.60 | 0.30 | 0.033 | 0.60 | 0.0008 | 0.0014 | 0.0015 | 0.0017 | 0.0019 | — | — | 970 | 1020 |
| a10 | 0.003 | 0.60 | 0.30 | 0.033 | 0.60 | 0.0033 | 0.0014 | 0.0015 | 0.0017 | 0.0019 | — | — | 970 | 1020 |
| a11 | 0.003 | 0.60 | 0.30 | 0.033 | 0.60 | 0.0016 | 0.0008 | 0.0015 | 0.0017 | 0.0019 | — | — | 970 | 1020 |
| a12 | 0.003 | 0.60 | 0.30 | 0.033 | 0.60 | 0.0016 | 0.0032 | 0.0015 | 0.0017 | 0.0019 | — | — | 970 | 1020 |
| a13 | 0.003 | 0.60 | 0.30 | 0.033 | 0.60 | 0.0016 | 0.0014 | 0.0009 | 0.0017 | 0.0019 | — | — | 970 | 1020 |
| a14 | 0.003 | 0.60 | 0.30 | 0.033 | 0.60 | 0.0016 | 0.0014 | 0.0033 | 0.0017 | 0.0019 | — | — | 970 | 1020 |
| a15 | 0.003 | 0.60 | 0.30 | 0.033 | 0.60 | 0.0016 | 0.0014 | 0.0015 | 0.0008 | 0.0019 | — | — | 970 | 1020 |
| a16 | 0.003 | 0.60 | 0.30 | 0.033 | 0.60 | 0.0016 | 0.0014 | 0.0015 | 0.0033 | 0.0019 | — | — | 970 | 1020 |
| a17 | 0.003 | 0.60 | 0.30 | 0.033 | 0.60 | 0.0016 | 0.0014 | 0.0015 | 0.0017 | 0.0032 | — | — | 970 | 1020 |
| a18 | 0.003 | 0.60 | 0.30 | 0.033 | 0.60 | 0.0016 | 0.0014 | 0.0015 | 0.0017 | 0.0019 | 0.21 | — | 970 | 1020 |
| a19 | 0.003 | 0.60 | 0.30 | 0.033 | 0.60 | 0.0016 | 0.0014 | 0.0015 | 0.0017 | 0.0019 | — | 0.22 | 970 | 1020 |
| a20 | 0.001 | 0.50 | 0.17 | 0.073 | 0.31 | 0.0008 | 0.0007 | 0.0005 | 0.0008 | 0.0011 | 0.10 | — | 955 | 1018 |

TABLE 2A

| REFERENCE SIGN OF HOT ROLLING | HOT ROLLING | | | | |
|---|---|---|---|---|---|
| | SLAB HEATING TEMPERATURE ° C. | AFTER ROUGH ROLLING HOLDING TEMPERATURE ° C. | AFTER ROUGH ROLLING REHEATING TEMPERATURE ° C. | FINAL TEMPERATURE OF FINAL ROLLING ° C. | COILING TEMPERATURE ° C. |
| B1 | 1050 | 900 | 990 | 850 | 800 |
| B2 | 1180 | 1020 | 1090 | 970 | 840 |
| B3 | 1160 | 850 | 1100 | 820 | 820 |
| B4 | 1150 | 1040 | 1070 | 880 | 830 |
| B5 | 1170 | 1000 | 1030 | 900 | 800 |
| B6 | 1130 | 1030 | 1110 | 920 | 830 |

TABLE 2A-continued

| HOT ROLLING | | | | | |
|---|---|---|---|---|---|
| REFERENCE | | AFTER ROUGH ROLLING | | FINAL TEMPERATURE | |
| SIGN OF HOT ROLLING | SLAB HEATING TEMPERATURE ° C. | HOLDING TEMPERATURE ° C. | REHEATING TEMPERATURE ° C. | OF FINAL ROLLING ° C. | COILING TEMPERATURE ° C. |
| B7 | 1060 | 950 | 1000 | 800 | 760 |
| B8 | 1170 | 1050 | 1100 | 1070 | 840 |
| B9 | 1160 | 1020 | 1070 | 1000 | 750 |
| B10 | 1150 | 1000 | 1050 | 950 | 850 |
| B11 | 1150 | 990 | 1060 | 900 | 800 |
| B12 | 1090 | 1010 | 1030 | 930 | 810 |
| B13 | 1050 | 900 | 980 | 850 | 800 |

TABLE 2B

| HOT ROLLING | | | | | |
|---|---|---|---|---|---|
| REFERENCE | | AFTER ROUGH ROLLING | | FINAL TEMPERATURE | |
| SIGN OF HOT ROLLING | SLAB HEATING TEMPERATURE ° C. | HOLDING TEMPERATURE ° C. | REHEATING TEMPERATURE ° C. | OF FINAL ROLLING ° C. | COILING TEMPERATURE ° C. |
| b1 | 1030 | — | — | — | — |
| b2 | 1200 | 950 | 1080 | 950 | 830 |
| b3 | 1100 | 830 | 1080 | 950 | 830 |
| b4 | 1100 | 1080 | 1080 | 950 | 830 |
| b5 | 1100 | 950 | 960 | 780 | 740 |
| b6 | 1100 | 950 | 1120 | 950 | 830 |
| b7 | 1100 | 950 | 1080 | 780 | 740 |
| b8 | 1100 | 950 | 1080 | 1070 | 830 |
| b9 | 1100 | 950 | 1080 | 950 | 740 |
| b10 | 1100 | 950 | 1080 | 950 | 870 |
| b11 | 1150 | NOT CONDUCTED | NOT CONDUCTED | 940 | 850 |
| b12 | 1150 | NOT CONDUCTED | NOT CONDUCTED | 890 | 800 |
| b13 | 1150 | NOT CONDUCTED | NOT CONDUCTED | 890 | 900 |

The chemical composition of the produced hot rolled steel sheet was the same as that of the slab. A test piece was cut out from the center area in transverse direction of the produced hot rolled steel sheet, a sample for the transmission electron microscope (TEM) was prepared so that an observed section was the cross section which was parallel to the rolling direction and the thickness direction, a visual field of 10 μm×10 μm was observed by the transmission electron microscope (TEM), and the number density of AlN with the equivalent circle diameter of 10 to 200 nm was obtained on the basis of the above method. The results are shown in Tables 3A to 3C.

TABLE 3A

| | | | | PRODUCTION RESULTS NUMBER DENSITY OF AlN | | EVALUATION RESULTS | | | | |
|---|---|---|---|---|---|---|---|---|---|---|
| No. | STEEL TYPE | REFERENCE SIGN OF HOT ROLLING | REFERENCE SIGN OF FINAL ANNEALING | IN GRAIN AND AT GRAIN BOUNDARY PIECES/ $\mu m^2$ | AT GRAIN BOUNDARY PIECES/ $\mu m^2$ | MAGNETIC FLUX DENSITY B50 T | IRON LOSS W15/50 W/Kg | MAGNETIC FLUX DENSITY B25 T | IRON LOSS W10/200 W/Kg | NOTE |
| D1 | A1 | B1 | C3 | 7.8 | 27 | 1.78 | 4.2 | 1.66 | 17.6 | INVENTIVE EXAMPLE |
| D2 | A2 | B2 | C3 | 7.6 | 26 | 1.76 | 4.1 | 1.65 | 17.0 | INVENTIVE EXAMPLE |
| D3 | A3 | B3 | C3 | 5.4 | 18 | 1.73 | 3.5 | 1.64 | 11.6 | INVENTIVE EXAMPLE |
| D4 | A4 | B4 | C3 | 3.4 | 12 | 1.74 | 4.3 | 1.64 | 16.5 | INVENTIVE EXAMPLE |
| D5 | A5 | B5 | C3 | 5.8 | 20 | 1.72 | 3.8 | 1.63 | 12.4 | INVENTIVE EXAMPLE |
| D6 | A6 | B6 | C3 | 6.3 | 24 | 1.73 | 3.9 | 1.64 | 12.7 | INVENTIVE EXAMPLE |
| D7 | A7 | B7 | C3 | 4.9 | 17 | 1.75 | 4.4 | 1.65 | 16.4 | INVENTIVE EXAMPLE |
| D8 | A8 | B8 | C3 | 7.3 | 25 | 1.72 | 3.3 | 1.63 | 12.2 | INVENTIVE EXAMPLE |
| D9 | A9 | B9 | C3 | 6.9 | 23 | 1.71 | 3.2 | 1.63 | 10.8 | INVENTIVE EXAMPLE |
| D10 | A10 | B10 | C3 | 7.2 | 25 | 1.71 | 3.4 | 1.63 | 11.3 | INVENTIVE EXAMPLE |

TABLE 3A-continued

| No. | STEEL TYPE | REFERENCE SIGN OF HOT ROLLING | REFERENCE SIGN OF FINAL ANNEALING | PRODUCTION RESULTS NUMBER DENSITY OF AlN: IN GRAIN AND AT GRAIN BOUNDARY PIECES/ $\mu m^2$ | PRODUCTION RESULTS NUMBER DENSITY OF AlN: AT GRAIN BOUNDARY PIECES/ $\mu m^2$ | EVALUATION RESULTS: MAGNETIC FLUX DENSITY B50 T | EVALUATION RESULTS: IRON LOSS W15/50 W/Kg | EVALUATION RESULTS: MAGNETIC FLUX DENSITY B25 T | EVALUATION RESULTS: IRON LOSS W10/200 W/Kg | NOTE |
|---|---|---|---|---|---|---|---|---|---|---|
| D11 | A11 | B11 | C3 | 5.9 | 21 | 1.72 | 3.1 | 1.63 | 10.5 | INVENTIVE EXAMPLE |
| D12 | A12 | B12 | C3 | 7.9 | 28 | 1.71 | 3.0 | 1.63 | 11.2 | INVENTIVE EXAMPLE |
| d1 | a1 | B7 | C3 | 3.3 | 12 | 1.74 | 5.6 | 1.64 | 19.2 | COMPARATIVE EXAMPLE |
| d2 | a2 | B13 | C3 | 3.4 | 12 | 1.74 | 5.6 | 1.64 | 19.2 | COMPARATIVE EXAMPLE |
| d3 | a3 | B6 | C3 | 3.4 | 12 | 1.67 | 4.2 | 1.61 | 17.6 | COMPARATIVE EXAMPLE |

TABLE 3B

| No. | STEEL TYPE | REFERENCE SIGN OF HOT ROLLING | REFERENCE SIGN OF FINAL ANNEALING | PRODUCTION RESULTS NUMBER DENSITY OF AlN: IN GRAIN AND AT GRAIN BOUNDARY PIECES/ $\mu m^2$ | PRODUCTION RESULTS NUMBER DENSITY OF AlN: AT GRAIN BOUNDARY PIECES/ $\mu m^2$ | EVALUATION RESULTS: MAGNETIC FLUX DENSITY B50 T | EVALUATION RESULTS: IRON LOSS W15/50 W/Kg | EVALUATION RESULTS: MAGNETIC FLUX DENSITY B25 T | EVALUATION RESULTS: IRON LOSS W10/200 W/Kg | NOTE |
|---|---|---|---|---|---|---|---|---|---|---|
| d4 | a4 | B6 | C3 | 4.2 | 17 | 1.74 | 5.5 | 1.64 | 18.4 | COMPARATIVE EXAMPLE |
| d5 | a5 | B7 | — | NOT COLD ROLLABLE | | — | — | — | — | COMPARATIVE EXAMPLE |
| d6 | a6 | B4 | — | NOT COLD ROLLABLE | | — | — | — | — | COMPARATIVE EXAMPLE |
| d7 | a7 | B4 | C3 | 3.2 | 11 | 1.74 | 5.7 | 1.64 | 20.3 | COMPARATIVE EXAMPLE |
| d8 | a8 | B6 | C3 | 7.5 | 29 | 1.67 | 4.6 | 1.61 | 17.8 | COMPARATIVE EXAMPLE |
| d9 | a9 | B7 | C3 | 12.5 | 63 | 1.68 | 5.9 | 1.61 | 22.5 | COMPARATIVE EXAMPLE |
| d10 | a10 | B7 | C3 | 3.7 | 13 | 1.68 | 5.6 | 1.61 | 19.1 | COMPARATIVE EXAMPLE |
| d11 | a11 | B7 | C3 | 12.6 | 62 | 1.68 | 5.8 | 1.61 | 22.7 | COMPARATIVE EXAMPLE |
| d12 | a12 | B7 | C3 | 3.4 | 13 | 1.68 | 5.7 | 1.61 | 19.5 | COMPARATIVE EXAMPLE |
| d13 | a13 | B7 | C3 | 12.2 | 63 | 1.67 | 5.9 | 1.61 | 22.3 | COMPARATIVE EXAMPLE |
| d14 | a14 | B7 | C3 | 3.6 | 14 | 1.67 | 5.8 | 1.61 | 20.1 | COMPARATIVE EXAMPLE |
| d15 | a15 | B7 | C3 | 12.8 | 64 | 1.68 | 5.6 | 1.61 | 21.9 | COMPARATIVE EXAMPLE |
| d16 | a16 | B7 | C3 | 3.5 | 13 | 1.67 | 5.6 | 1.61 | 18.8 | COMPARATIVE EXAMPLE |
| d17 | a17 | B7 | C3 | 38.8 | 126 | 1.67 | 6.4 | 1.61 | 23.7 | COMPARATIVE EXAMPLE |
| d18 | a18 | B7 | — | NOT COLD ROLLABLE | | — | — | — | — | COMPARATIVE EXAMPLE |

TABLE 3C

| No. | STEEL TYPE | REFERENCE SIGN OF HOT ROLLING | REFERENCE SIGN OF FINAL ANNEALING | PRODUCTION RESULTS NUMBER DENSITY OF AlN: IN GRAIN AND AT GRAIN BOUNDARY PIECES/ $\mu m^2$ | PRODUCTION RESULTS NUMBER DENSITY OF AlN: AT GRAIN BOUNDARY PIECES/ $\mu m^2$ | EVALUATION RESULTS: MAGNETIC FLUX DENSITY B50 T | EVALUATION RESULTS: IRON LOSS W15/50 W/Kg | EVALUATION RESULTS: MAGNETIC FLUX DENSITY B25 T | EVALUATION RESULTS: IRON LOSS W10/200 W/Kg | NOTE |
|---|---|---|---|---|---|---|---|---|---|---|
| d19 | a19 | B7 | — | NOT COLD ROLLABLE | | — | — | — | — | COMPARATIVE EXAMPLE |
| d20 | A6 | b1 | — | NOT HOT ROLLABLE | | — | — | — | — | COMPARATIVE EXAMPLE |
| d21 | A6 | b2 | C3 | 12.6 | 65 | 1.68 | 6.0 | 1.61 | 24.2 | COMPARATIVE EXAMPLE |
| d22 | A6 | b3 | C3 | 11.6 | 47 | 1.68 | 5.7 | 1.61 | 20.2 | COMPARATIVE EXAMPLE |
| d23 | A6 | b4 | C3 | 14.0 | 64 | 1.68 | 5.8 | 1.61 | 22.8 | COMPARATIVE EXAMPLE |
| d24 | A6 | b5 | C3 | 6.1 | 25 | 1.65 | 5.6 | 1.60 | 18.6 | COMPARATIVE EXAMPLE |

TABLE 3C-continued

| No. | STEEL TYPE | REFERENCE SIGN OF HOT ROLLING | REFERENCE SIGN OF FINAL ANNEALING | PRODUCTION RESULTS NUMBER DENSITY OF AlN: IN GRAIN AND AT GRAIN BOUNDARY PIECES/ $\mu m^2$ | PRODUCTION RESULTS NUMBER DENSITY OF AlN: AT GRAIN BOUNDARY PIECES/ $\mu m^2$ | EVALUATION RESULTS: MAGNETIC FLUX DENSITY B50 T | EVALUATION RESULTS: IRON LOSS W15/50 W/Kg | EVALUATION RESULTS: MAGNETIC FLUX DENSITY B25 T | EVALUATION RESULTS: IRON LOSS W10/200 W/Kg | NOTE |
|---|---|---|---|---|---|---|---|---|---|---|
| d25 | A6 | b6 | C3 | 13.8 | 60 | 1.68 | 5.9 | 1.61 | 22.1 | COMPARATIVE EXAMPLE |
| d26 | A6 | b7 | C3 | 6.2 | 25 | 1.65 | 5.6 | 1.60 | 18.7 | COMPARATIVE EXAMPLE |
| d27 | A6 | b8 | C3 | 12.2 | 45 | 1.68 | 5.8 | 1.61 | 20.9 | COMPARATIVE EXAMPLE |
| d28 | A6 | b9 | C3 | 6.2 | 24 | 1.65 | 5.6 | 1.60 | 18.5 | COMPARATIVE EXAMPLE |
| d29 | A6 | b10 | — | POOR DESCALING | | — | — | — | — | COMPARATIVE EXAMPLE |
| d30 | a20 | b11 | C3 | 12.3 | 67 | 1.79 | 3.8 | 1.66 | 19.2 | COMPARATIVE EXAMPLE |
| d31 | a20 | b12 | C3 | 11.5 | 59 | 1.78 | 3.5 | 1.66 | 18.6 | COMPARATIVE EXAMPLE |
| d32 | a20 | b13 | — | POOR DESCALING | | — | — | — | — | COMPARATIVE EXAMPLE |

The produced hot rolled steel sheet was pickled, was cold-rolled to 0.5 mm to obtain a cold rolled steel sheet, and was final-annealed under condition corresponding to a reference sign of final annealing shown in Table 4 to obtain the non oriented electrical steel sheet.

TABLE 4

| FINAL ANNEALING: REFERENCE SIGN OF FINAL ANNEALING | FINAL ANNEALING: FINAL ANNEALING TEMPERATURE ° C. |
|---|---|
| C1 | 800 |
| C2 | 1070 |
| C3 | 900 |
| C4 | 850 |

From the non oriented electrical steel sheet after final annealing, a test piece of 55 mm square was cut out so as to be parallel to the rolling direction and the thickness direction. The iron loss and the magnetic flux density were measured by the method on the basis of the single sheet tester (JIS C 2556: 2015), and the average of L direction and C direction was obtained.

For the iron loss, in addition to W15/50 which was a conventional and general evaluation, W10/200 which was the iron loss in high frequency was also measured. W15/50 is the iron loss when the non oriented electrical steel sheet is excited so as to be 1.5 T at 50 Hz, and W10/200 is the iron loss when the non oriented electrical steel sheet is excited so as to be 1.0 T at 200 Hz.

For the magnetic flux density, B50 and B25 were measured. B50 is the magnetic flux density when the non oriented electrical steel sheet is magnetized with a magnetizing force of 5000 A/m at 50 Hz, and B25 is the magnetic flux density when the non oriented electrical steel sheet is magnetized with a magnetizing force of 2500 A/m at 50 Hz.

When W15/50 was less than 5.2 W/kg, W10/200 was less than 18.0 W/kg, B50 was 1.69 T or more, and B25 was 1.62 T or more, it was judged to as acceptable. The results are also shown in Tables 3A to 3C.

As shown in Tables 3A to 3C, the inventive examples satisfied the chemical composition and the number density of AlN, and thus, the magnetic characteristics thereof were excellent. On the other hand, as shown in Tables 3A to 3C, the comparative examples did not satisfy either the chemical composition or the number density of AlN, and thus, the productivity or the magnetic characteristics thereof were not excellent.

In the comparative examples No. d30 and No. d31, the amounts of Ti, Nb, V and Zr in the slab composition did not satisfy the preferred ranges, the rough rolled sheet after rough rolling was not held in the temperature range of 850° C. to Ar1 point, and the rough rolled sheet after rough rolling was not reheated to the temperature range of more than Ar1 point to Ac1 point. In the comparative examples No. d30 and No. d31, since the rolling was conducted while taking care not to decrease the steel sheet temperature during rough rolling and during final rolling, the final temperature of final rolling became 800° C. or more without reheating after rough rolling. In the comparative examples No. d30 and No. d31, since the holding and the reheating after rough rolling were not conducted although the final temperature of final rolling was 800° C. or more, the number density of AlN in the hot rolled steel sheet was not favorably controlled. As a result, in the comparative examples No. d30 and No. d31, although W15/50 was satisfied, W10/200 was not excellent as the non oriented electrical steel sheet.

Example 2

A slab with the chemical composition shown in Tables 1A to 1B was hot-rolled to a thickness of 2.5 mm under production condition corresponding to a reference sign of hot rolling shown in Tables 2A to 2B, and a hot rolled steel sheet was coiled.

The chemical composition of the produced hot rolled steel sheet was the same as that of the slab. A test piece was cut out from the center area in transverse direction of the produced hot rolled steel sheet, a sample for the transmission electron microscope (TEM) was prepared so that an observed section was the cross section which was parallel to the rolling direction and the thickness direction, a visual field of 10 μm×10 μm was observed by the transmission electron microscope (TEM), and the number density of AlN with the equivalent circle diameter of 10 to 200 nm was obtained on the basis of the above method. The results are shown in Table 5.

TABLE 5

| No. | STEEL TYPE | REFERENCE SIGN OF HOT ROLLING | REFERENCE SIGN OF FINAL ANNEALING | PRODUCTION RESULTS NUMBER DENSITY OF AlN: IN GRAIN AND AT GRAIN BOUNDARY PIECES/ $\mu m^2$ | PRODUCTION RESULTS NUMBER DENSITY OF AlN: AT GRAIN BOUNDARY PIECES/ $\mu m^2$ | EVALUATION RESULTS: MAGNETIC FLUX DENSITY B50 T | EVALUATION RESULTS: IRON LOSS W15/50 W/Kg | EVALUATION RESULTS: MAGNETIC FLUX DENSITY B25 T | EVALUATION RESULTS: IRON LOSS W10/200 W/Kg | NOTE |
|---|---|---|---|---|---|---|---|---|---|---|
| F1 | A11 | B11 | C1 | 5.9 | 20 | 1.75 | 4.4 | 1.65 | 14.0 | INVENTIVE EXAMPLE |
| F2 | A12 | B12 | C2 | 7.9 | 28 | 1.70 | 2.8 | 1.62 | 11.3 | INVENTIVE EXAMPLE |
| F3 | A11 | B11 | C3 | 5.9 | 21 | 1.72 | 3.1 | 1.63 | 10.5 | INVENTIVE EXAMPLE |
| F4 | A12 | B12 | C4 | 7.9 | 27 | 1.71 | 3.3 | 1.63 | 12.0 | INVENTIVE EXAMPLE |

The produced hot rolled steel sheet was pickled, was cold-rolled to 0.5 mm to obtain a cold rolled steel sheet, and was final-annealed under condition corresponding to a reference sign of final annealing shown in Table 4 to obtain the non oriented electrical steel sheet.

From the non oriented electrical steel sheet after final annealing, a test piece of 55 mm square was cut out so as to be parallel to the rolling direction and the thickness direction. The iron loss and the magnetic flux density were measured by the method on the basis of the single sheet tester (JIS C 2556: 2015), and the average of L direction and C direction was obtained.

For the iron loss, in addition to W15/50 which was a conventional and general evaluation, W10/200 which was the iron loss in high frequency was also measured. For the magnetic flux density, B50 and B25 were measured.

As with Example 1, when W15/50 was less than 5.2 W/kg, W10/200 was less than 18.0 W/kg, B50 was 1.69 T or more, and B25 was 1.62 T or more, it was judged to as acceptable. The results are also shown in Table 5.

As shown in Table 5, the inventive examples satisfied the chemical composition and the number density of AlN, and thus, the magnetic characteristics thereof were excellent.

INDUSTRIAL APPLICABILITY

According to the above aspects of the present invention, it is possible to provide the hot rolled steel sheet for the non oriented electrical steel sheet which can improve the iron loss in high frequency in addition to general magnetic characteristics, the producing method of the hot rolled steel sheet for the non oriented electrical steel sheet, and the producing method of the non oriented electrical steel sheet. Accordingly, the present invention has significant industrial applicability.

The invention claimed is:

1. A hot rolled steel sheet for a non oriented electrical steel sheet, the hot rolled steel sheet comprising, as a chemical composition, by mass %, 0.005% or less of C,
0.10 to 1.50% of Si,
0.10 to 0.60% of Mn,
0.100% or less of P,
0.20 to 1.00% of Al,
0.0010 to 0.0030% of Ti,
0.0010 to 0.0030% of Nb,
0.0010 to 0.0030% of V,
0.0010 to 0.0030% of Zr,
0.0030% or less of N,
0 to 0.20% of Sn,
0 to 0.20% of Sb, and
a balance consisting of Fe and impurities, wherein
a cross section which is parallel to a rolling direction and a thickness direction is viewed,
an AlN with an equivalent circle diameter of 10 to 200 nm exists in a grain and at a grain boundary of a ferrite grain,
a number density of the AlN which exists in the grain and at the grain boundary is 0.1 to 8.0 pieces/$\mu m^2$ on basis of an observed area, and
a number density of the AlN which exists at the grain boundary is 12 to 40 pieces/$\mu m^2$ on basis of a grain boundary area.

2. The hot rolled steel sheet for the non oriented electrical steel sheet according to claim 1, the hot rolled steel sheet comprising, as the chemical composition, by mass%, at least one of 0.02 to 0.20% of Sn, and
0.02 to 0.20% of Sb.

3. A producing method of the hot rolled steel sheet for the non oriented electrical steel sheet according to claim 1, the method comprising heating a slab to a temperature range of 1050 to 1180 °C, the slab including, as a chemical composition, by mass%,
005% or less of C,
0.10 to 1.50% of Si,
0.10 to 0.60% of Mn,
100% or less of P,
0.20 to 1.00% of Al,
0.0010 to 0.0030% of Ti,
0.0010 to 0.0030% of Nb,
0.0010 to 0.0030% of V,
0.0010 to 0.0030% of Zr,
0.0030% or less of N,
0 to 0.20% of Sn,
0 to 0.20% of Sb, and
a balance consisting of Fe and impurities,
rough-rolling the slab after the heating,
holding a rough-rolled sheet after the rough-rolling in a temperature range of 850 °C to Ar1 point,
reheating the rough-rolled sheet after the holding to a temperature range of more than Ar1 point to Ac1 point,
final-rolling the rough-rolled sheet just after the reheating under conditions such that a final temperature of the final-rolling is 800 °C. to Ar1 point, and
coiling a final-rolled sheet after the final-rolling in a temperature range of 750 to 850 °C.

4. A producing method of a non oriented electrical steel sheet using the hot rolled steel sheet for the non oriented electrical steel sheet according to claim 1, the method comprising cold-rolling the hot rolled steel sheet for the non oriented electrical steel sheet without conducting a hot-rolled sheet annealing, and final-annealing a cold-rolled sheet after the cold-rolling in a range of 800 °C to Ac1 point.

5. A producing method of the hot rolled steel sheet for the non oriented electrical steel sheet according to claim 2, the method comprising heating a slab to a temperature range of 1050 to 1180 °C, the slab including, as a chemical composition, by mass%, 005% or less of C, 0.10 to 1.50% of Si, 0.10 to 0.60% of Mn, 0.100% or less of P, 0.20 to 1.00% of Al, 0.0010 to 0.0030% of Ti, 0.0010 to 0.0030% of Nb, 0.0010 to 0.0030% of V, 0.0010 to 0.0030% of Zr, 0.0030% or less of N, 0 to 0.20% of Sn, 0 to 0.20% of Sb, and a balance consisting of Fe and impurities, rough-rolling the slab after the heating, holding a rough-rolled sheet after the rough-rolling in a temperature range of 850 °C to Ar1 point, reheating the rough-rolled sheet after the holding to a temperature range of more than Ar1 point to Ac1 point, final-rolling the rough-rolled sheet just after the reheating under conditions such that a final temperature of the final-rolling is 800 °C to Ar1 point, and coiling a final-rolled sheet after the final-rolling in a temperature range of 750 to 850 °C.

6. A producing method of the hot rolled steel sheet for the non oriented electrical steel sheet according to claim 1, the method comprising heating a slab to a temperature range of 1050 to 1180 °C, the slab including, as a chemical composition, by mass %, 005% or less of C, 0.10 to 1.50% of Si, 0.10 to 0.60% of Mn, 0.100% or less of P, 0.20 to 1.00% of Al, 0.0010 to 0.0030% of Ti, 0.0010 to 0.0030% of Nb, 0.0010 to 0.0030% of V, 0.0010 to 0.0030% of Zr, 0.0030% or less of N, 0 to 0.20% of Sn, 0 to 0.20% of Sb, and a balance comprising Fe and impurities, rough-rolling the slab after the heating, holding a rough-rolled sheet after the rough-rolling in a temperature range of 850 °C to Ar1 point, reheating the rough-rolled sheet after the holding to a temperature range of more than Ar1 point to Ac1 point, final-rolling the rough-rolled sheet just after the reheating under conditions such that a final temperature of the final-rolling is 800 °C to Ar1 point, and coiling a final-rolled sheet after the final-rolling in a temperature range of 750 to 850 °C.

7. A producing method of the hot rolled steel sheet for the non oriented electrical steel sheet according to claim 2, the method comprising heating a slab to a temperature range of 1050 to 1180 °C, the slab including, as a chemical composition, by mass%, 005% or less of C, 0.10 to 1.50% of Si, 10 to 0.60% of Mn, 0.100% or less of P, 0.20 to 1.00% of Al, 0.0010 to 0.0030% of Ti, 0.0010 to 0.0030% of Nb, 0010 to 0.0030% of V, 0010 to 0.0030% of Zr, 0030% or less of N, 0 to 0.20% of Sn, 0 to 0.20% of Sb, and a balance comprising Fe and impurities, rough-rolling the slab after the heating, holding a rough-rolled sheet after the rough-rolling in a temperature range of 850 °C to Ar1 point, reheating the rough-rolled sheet after the holding to a temperature range of more than Ar1 point to Acl point, final-rolling the rough-rolled sheet just after the reheating under conditions such that a final temperature of the final-rolling is 800 °C to Ar1 point, and coiling a final-rolled sheet after the final-rolling in a temperature range of 750 to 850 °C.

8. A producing method of a non oriented electrical steel sheet using the hot rolled steel sheet for the non oriented electrical steel sheet according to claim 2, the method comprising cold-rolling the hot rolled steel sheet for the non oriented electrical steel sheet without conducting a hot-rolled sheet annealing, and final-annealing a cold-rolled sheet after the cold-rolling in a range of 800 °C to Acl point; thereby producing the non oriented electrical steel sheet.

9. A hot rolled steel sheet for a non oriented electrical steel sheet, the hot rolled steel sheet comprising, as a chemical composition, by mass %, 0.005% or less of C, 0.10 to 1.50% of Si, 0.10 to 0.60% of Mn, 0.100% or less of P, 0.20 to 1.00% of Al, 0.0010 to 0.0030% of Ti, 0.0010 to 0.0030% of Nb, 0.0010 to 0.0030% of V, 0.0010 to 0.0030% of Zr, 0.0030% or less of N, 0 to 0.20% of Sn, 0 to 0.20% of Sb, and a balance comprising Fe and impurities, wherein a cross section which is parallel to a rolling direction and a thickness direction is viewed, an AlN with an equivalent circle diameter of 10 to 200 nm exists in a grain and at a grain boundary of a ferrite grain, a number density of the AlN which exists in the grain and at the grain boundary is 0.1 to 8.0 pieces/$\mu m^2$ on basis of an observed area, and a number density of the AlN which exists at the grain boundary is 12 to 40 pieces/$\mu m^2$ on basis of a grain boundary area.

* * * * *